US008291665B2

(12) United States Patent
Sondermann

(10) Patent No.: US 8,291,665 B2
(45) Date of Patent: Oct. 23, 2012

(54) REVERSIBLE BASEBOARD FOR COVERING AT LEAST A FLOORING BORDER

(75) Inventor: Frank Sondermann, Drolshagen (DE)

(73) Assignee: Kueberit Profile Systems GmbH & Co. KG, Luedenscheid (DE)

( * ) Notice: Subject to any disclaimer, the term of this patent is extended or adjusted under 35 U.S.C. 154(b) by 240 days.

(21) Appl. No.: 12/778,744

(22) Filed: May 12, 2010

(65) Prior Publication Data

US 2010/0287870 A1 Nov. 18, 2010

(30) Foreign Application Priority Data

May 18, 2009 (DE) ..... 20 2009 007 156 U

(51) Int. Cl.
*E04D 1/36* (2006.01)

(52) U.S. Cl. ..... 52/466; 52/459; 52/464; 52/468; 52/DIG. 4

(58) Field of Classification Search ..... 52/459, 52/465, 466, 468, 772, 774, 775, DIG. 4
See application file for complete search history.

(56) References Cited

U.S. PATENT DOCUMENTS 4,934,119 A * 6/1990 Ybarra ..... 52/238.1
6,340,264 B1 * 1/2002 Nelson ..... 403/297
6,345,480 B1 * 2/2002 Kemper et al. ..... 52/395
6,588,165 B1 * 7/2003 Wright ..... 52/506.05
7,392,627 B2 * 7/2008 Sondermann ..... 52/464
7,409,802 B2 * 8/2008 Fiedler ..... 52/466
7,559,177 B2 * 7/2009 Stanchfield ..... 52/459
7,797,900 B2 * 9/2010 Sondermann ..... 52/466
7,895,802 B2 * 3/2011 Kurz ..... 52/468
8,074,407 B2 * 12/2011 Sondermann ..... 52/177
2003/0051426 A1 * 3/2003 Kornfalt ..... 52/396.1
2005/0150182 A1 * 7/2005 Stanchfield ..... 52/459
2007/0056239 A1 * 3/2007 Schacht et al. ..... 52/582.1
2007/0175147 A1 * 8/2007 Fiedler ..... 52/466
2007/0245662 A1 * 10/2007 Stanchfield ..... 52/459
2010/0031596 A1 * 2/2010 Muehlebach ..... 52/466

* cited by examiner

*Primary Examiner* — Jeanette E Chapman
*Assistant Examiner* — James Buckle, Jr.
(74) *Attorney, Agent, or Firm* — Robert L. Epstein; Epstein Drangel LLP

(57) ABSTRACT

A profile rail system (1) is used to cover a covering edge (2). The profile rail system (1) consists of at least one base rail (4) and at least one cover rail (5) that can be adjusted relative to the base rail. The base rail (4) and cover rail (5) are held together by at least one permanent magnet (20) in such a way that the cover rail (5) is pulled towards the base rail (4). At least a section of the base rail (4) and cover rail (5) can be magnetized to achieve a polarity-independent force effect of the permanent magnet (20).

11 Claims, 2 Drawing Sheets

REVERSIBLE BASEBOARD FOR COVERING AT LEAST A FLOORING BORDER

The present applications claims priority to German patent application no: DE 20 2009 007 156.1, filed May 18, 2009.

FIELD OF THE INVENTION

This invention relates to a profile rail system for covering at least one covering edge.

DESCRIPTION OF THE PRIOR ART

An arrangement with magnetic fastening device for covering of a joint or an edge is known from EP 1 837 454 A2. This arrangement comprises a base rail and a cover rail that can be adjusted relative to one another. The base rail is attached to a base while the cover rail extends over edges of covering. Permanent magnets with opposite polarity are provided in the base and cover rails to hold the cover rail on the base rail. In this way, the cover rail is preloaded when it is pulled onto adjacent coverings. In addition, no fastening means can be seen from the visible side of the covering. This arrangement has proven its value in practice and is the starting point for the present invention.

It is the problem of this invention to provide a profile rail system of the type mentioned above that is characterized by improved functionality.

This problem is solved according to the invention by the following characteristics.

BRIEF SUMMARY OF THE INVENTION

The profile rail system according to the invention is used to cover at least one covering edge. The covering may consist of any material such as laminate, wood, parquetry, a polymer, natural or artificial stone. This list is not exhaustive but just exemplary. If the profile rail system covers only one covering edge, it is used as trimming or ramp. Alternatively, the profile rail system can cover multiple covering edges so that it is provided between two coverings, especially in an expansion joint or a transition from one covering to another. The profile rail system can be used on floor, wall, and ceiling coverings as well as a baseboard or stair edge profile. This, too, should be considered exemplary and not exhaustive. The profile rail system comprises a base rail that can preferably be attached to a base. The preferred means for fastening are screws, dowels, or glued joints. However it is not required that the rail be fastened to a base. The base rail may for example have a leg that slides under the adjacent covering to achieve attachment of the base rail. Furthermore, the profile rail system comprises a cover rail that can be adjusted relative to the base rail. The cover rail is preferably movable relative to the base rail for height adjustment of the cover rail to match the thickness of the respective adjacent covering. To ensure proper sealing of the covering by the cover rail, at least one permanent magnet is provided that pulls the cover rail against the base rail. Specifically, this permanent magnet is to apply a tensile force to the cover rail to pull it against the adjacent covering. However, it has proven disadvantageous to use two magnets with opposite polarity for applying this tensile force. If two magnets are used, very different field strengths may result depending on the geometry of the profile rail system and the relative positioning of base rail and cover rail that may in some cases even cause the magnets to repel each other. This issue has resulted in the fact that magnetic profile rail systems for covering edges of coverings have not yet caught on. This issue can be solved by refraining from using magnets with opposite polarity and instead making both the base rail and the cover rail or at least a section thereof magnetizable. The result is that the permanent magnet is neither functionally associated with the base rail nor with the cover rail but represents a fastening means that forms a non-positive joint of the two rails. In this way, the base rail or cover rail is magnetized always and regardless of the respective rail geometry with a polarity opposite to that of the permanent magnet, which facilitates a constant strong tensile force of the cover rail against the base rail across the entire adjustment path of the cover rail. This makes the magnetic holding system of the cover rail fit for practical application and brings out its advantages particularly well. In particular, the holding system, unlike a screwed joint, is not visible from outside. Since the cover rail is only held in a non-positive joint and not in positive engagement like a snap-in connection, the cover rail can easily be removed from the base rail by overcoming the holding force. In this way, the space underneath the cover rail can easily be made accessible. This is particularly important for revisions. The space under the cover rail can also easily be used as a cable duct, and a cable can be installed or replaced even after the profile rail system has been completed. The magnetic attachment of the cover rail also eliminates fatigue of the holding mechanism of the cover rail as is known, for example, from snap-in plug-and-socket-type connections. Ferromagnetic materials have particularly proven their value as magnetizable materials for the base or cover rail since these can achieve considerably higher coercive field strengths than paramagnetic materials. Preferred materials are iron, cobalt and/or nickel and alloys made thereof. Many ferromagnetic materials are very hard and thus difficult to machine. Many ferromagnetic materials are also subject to corrosion.

Due to poor machinability it is typically not beneficial to manufacture the entire base rail or cover rail from a magnetizable material although this is generally possible. Instead, it is advantageous if the base rail or the cover rail, respectively, is at least made of two pieces. This rail comprises at least one non-ferromagnetic profile rail to which at least one ferromagnetic metal sheet is attached. In this way, the magnetizable material does not have to be incorporated in the typically complex shape of the profile rail. It is sufficient to produce a more or less narrow strip of sheet metal from the ferromagnetic material. The profile rail can be made of an easily moldable, castable, or extrudable material so that even complex shapes can be produced cost-effectively. Such manufacturing methods are not feasible with justifiable effort for ferromagnetic materials. But a simple sheet metal strip of a ferromagnetic material can be manufactured easily and at low cost.

It is preferred for easily achieving a positive, form-fitting connection of the ferromagnetic sheet and the profile rail that the profile rail comprises at least one undercut holder into which the ferromagnetic sheet can be slid.

This holder can for example be formed by two vertical ribs that are undercut on the sides that face each other. These ribs and a base leg form a pocket that holds the ferromagnetic sheet. The undercut of the holder ensures that the ferromagnetic sheet can withstand tensile forces applied by permanent magnets.

It is a major problem of permanent-magnet holding systems that the Lorentz force depends on the spacing between the magnet and the ferromagnetic material. This force declines with the third power of the spacing so that sufficient holding force is feasible at a very narrow height adjustment range only if the permanent magnet is fixed.

It is useful for solving this problem if the permanent magnet is in abutment with the base rail and the cover rail at various positions of the cover rail. This can easiest be achieved by making the permanent magnet freely adjustable between the base rail and the cover rail. Alternatively, the permanent magnet could also be pivoted, however this is typically not required. This measure ensures that the relative spacing between the permanent magnet on the one hand and the cover or base rail on the other always zero, allowing the permanent magnet to exert its maximum force effect in every relative position of the cover and base rails. This ensures a large height adjustment range of the profile rail system so that it can handle all types of covering used in practice.

Abutment of the permanent magnet is simply achieved by arranging the permanent magnet at an acute angle to the base or cover rail. In this way, the permanent magnet can constantly remain in contact with the base rail or cover rail and apply the desired tensile force by changing its set angle to the base or cover rail.

It is advantageous for another improvement of the force effect between the permanent magnet and the base or cover rail that the permanent magnet is rounded at the contact surfaces with the base or cover rail. This rounding increases the effective area of the permanent magnet. This effective area would be relatively small for a knife-type edge of the permanent magnet since it would only ensure contact of the permanent magnet along a line and that contact would decline rapidly at a very small distance from the contact line between the permanent magnet and the base or cover rail, respectively. The mutual increase in spacing is reduced many times over by the rounded shape of the permanent magnet so that a considerably larger area contributes to the magnetic flux. This increases the Lorentz force that is proportional to the cross-sectional area of the magnetic flux.

If the cover rail is to be height-adjustable and pivotable, it is beneficial that the rounding is convex. This increases the cross-sectional area of the magnetic flux in two dimensions so that the permanent magnet can be rotated about two axes. Thus both the height and the angular position of the cover rail can be adjusted about a longitudinal axis of the cover rail without reducing the force effect of the permanent magnet.

Despite the described measures aimed at increasing the cross-sectional area of the magnetic flux, it is relatively small in relation to a flatly positioned magnet because only a small portion of the available magnetic area can be utilized. Therefore, either a larger number of magnets or magnets with a higher coercive field strength such as samarium cobalt magnets are preferred. If however such magnets rest evenly on a ferromagnetic material, they can virtually not be separated from the ferromagnet without using destructive forces. This is why care should be taken to avoid level contact of the permanent magnet with the ferromagnetic material when the profile rail is installed. To ensure this in all circumstances, it is advantageous to cover the base or cover rail partially by a non-ferromagnetic material. Such non-ferromagnetic materials can include a plastic, aluminum, copper or the like, this list to be considered exemplary, not exhaustive. The cover prevents level contact of the permanent magnet with the ferromagnetic material so that the holding force between the cover rail and the base rail remains within acceptable limits during installation of the profile rail system as well. Alternatively or in addition, the contact surface of the ferromagnetic material and the permanent magnet can also have a non-level shape. For example, the contact surface could be domed or tilted.

It is finally advantageous for a simple design of the profile rail system if the permanent magnet has opposite magnetic poles at its contact sites with the base or cover rail. In this way, the full length of the permanent magnet can be utilized for adjusting the cover rail relative to the base rail.

BRIEF DESCRIPTION OF THE SEVERAL VIEWS OF DRAWINGS

Other advantages and characteristics of this invention will be explained in the detailed description below with reference to the associated figures that contain several embodiments of this invention. It should however be understood that the figure is just used to illustrate the invention and does not limit the scope of protection of the invention.

Wherein.

DETAILED DESCRIPTION OF THE INVENTION

Figure 1:
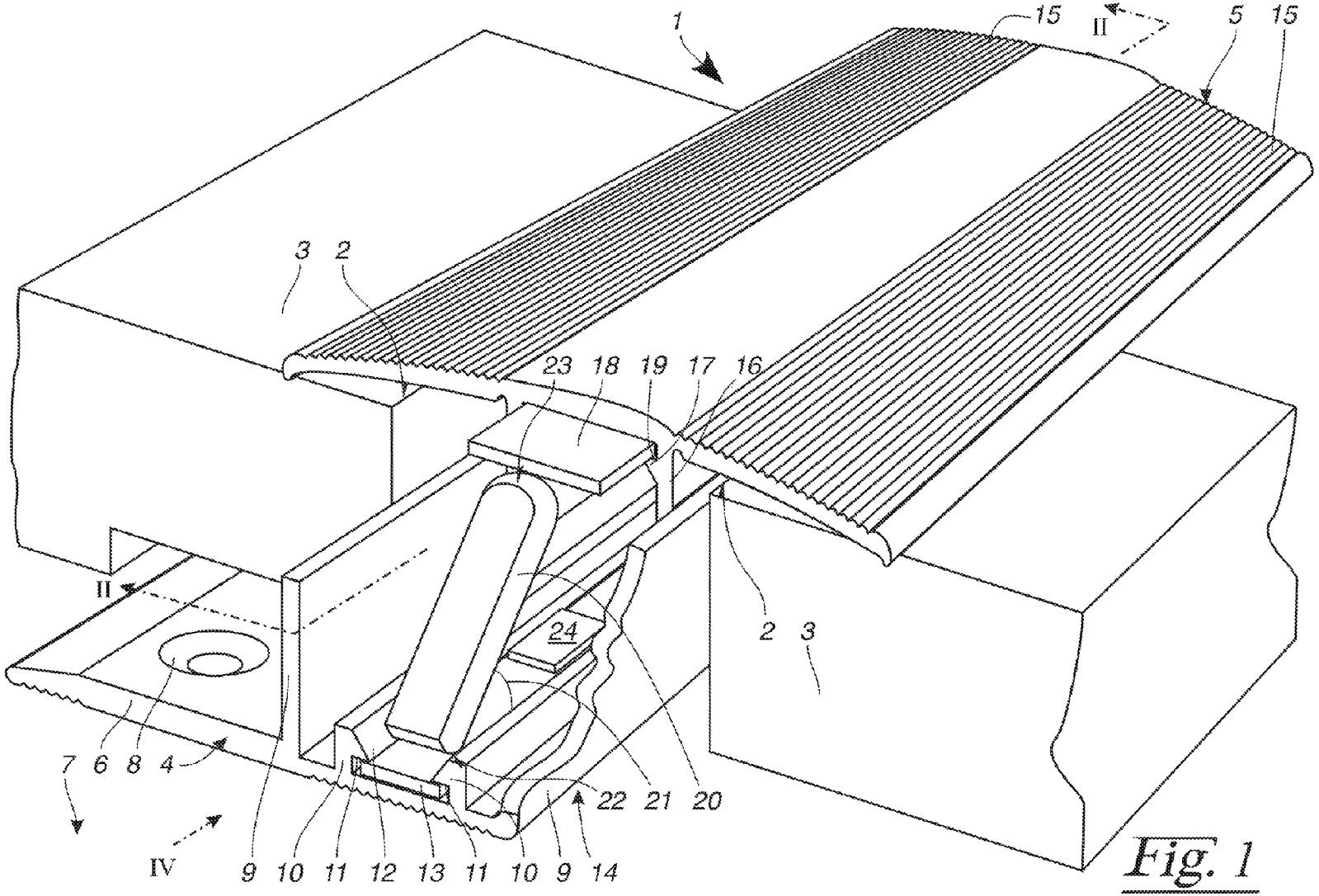
FIG. 1 is a three-dimensional representation of a profile rail system.

FIG. 1 shows a profile rail system 1 for covering two edges 2 of coverings 3. The profile rail system 1 comprises a base rail 4 and a cover rail 5.

The base rail 4 comprises a base leg 6 that can be attached to a base 7. The base leg 6 has several holes 8 for this purpose into which screws that are not shown here can be inserted. The base leg 6 can either be directly screwed onto the base 7, or glued to it or attached to it indirectly using dowels.

The base rail 4 also comprises two vertical guide ribs 9 that limit the lateral movability of the cover rail 5 and thus facilitate the installation of the profile rail system. As an alternative to the embodiment shown, a variant can be conceived that makes do without guide ribs 9.

Two holding ribs 10 are provided on the base leg 6 of the base rail 4 that comprise undercuts 11 that face each other. These holding legs 10 form a holder 12 for a ferromagnetic sheet metal piece 13 that can be slid into the holder 12. Alternatively, the narrowest distance between the holding ribs 10 can be made slightly smaller than the width of the ferromagnetic sheet metal piece 13 so that the ferromagnetic sheet metal piece 13 can be snapped into the holder 12 from the top. It is preferred in this case that the undercut 11 of the holding ribs 10 is dimensioned particularly small.

The base leg 6 forms a profile rail 14 together with the guide ribs 9 and the holder 12 that is shown as a one-piece component made by extrusion molding. This profile rail 14 and a ferromagnetic sheet metal piece 13 form the base rail 4.

The cover rail 5 comprises two cover wings 15 that cover the two covering edges 2. In addition, the cover rail 5 comprises two guide ribs 16 that interact with the guide ribs 9 of the base rail 4 and implement the guide effect.

A holder 17 for another ferromagnetic sheet metal piece 18 is provided on the guide ribs 16. This holder 17 has an undercut 19 like the holder 12 of the base rail 4. The undercut 19 can be formed in the same way as the undercut 11 of the base leg 6. In particular, it is conceived that the ferromagnetic sheet metal piece 18 can be slid or snapped into the holder 17.

It is important for achieving secure covering of the covering edges 2 that the cover wings 15 are pulled towards the coverings 3. The tensile force is applied by several permanent magnets 20 that are arranged at an acute angle 21 to the base rail 4. These permanent magnets 20 are placed along the length of the profile rail system 1, and FIG. 1 only shows one of the permanent magnets 20.

The permanent magnet 20 is rounded at the contact areas with the ferromagnetic sheet metal pieces 13, 18 to increase the cross-sectional area of the magnetic flux and thus the force effect of the permanent magnet 20. A cylindrical rounding 22 is formed in the contact area with the base rail 4. It is not important whether this rounding is of circular, elliptical, parabolic or another cylindrical design.

The permanent magnet 20 comprises a convex rounding 23 in the contact area with the ferromagnetic sheet metal piece 18 on the cover rail. Unlike the cylindrical rounding, this convex rounding 23 allows pivoting of the cover rail 5 about a longitudinal axis of the profile rail system 1 without reducing the cross-sectional area of the magnetic flux to a single point. As an alternative to the embodiment shown in FIG. 1, both contact areas of the permanent magnet 20 can be cylindrical or convex in design. The exact shape of a convex rounding 23 of the permanent magnet 20 does not matter. The permanent magnet 20 can have a convex rounding 23 in the shape of a ball, an ellipsoid, a paraboloid or another shape.

To prevent the permanent magnet 20 from abutting level with the ferromagnetic sheet metal piece 13, 18, the ferromagnetic sheet metal piece 13, 18 is partially covered by a non-ferromagnetic material 24. Thus the set angle 21 of the permanent magnet 20 can no longer be reduced to zero so that the permanent magnet 20 has a generally line or point-shaped contact with the ferromagnetic sheet metal piece 13, in any position it can take. If the surface of the ferromagnetic sheet metal piece 13 is not even, level abutment of the permanent magnet 20 is ruled out by its shape so that the non-ferromagnetic material 24 is expendable.

The function of the profile rail system 1 will be explained with reference to the cross-sectional views shown in FIG. 2 or 3 below; the same reference symbols denote the same components. The cross-sectional view shows in particular that the permanent magnet 20 has a line-shaped contact site 25 with the ferromagnetic sheet metal piece 13. The contact site 26 with the ferromagnetic sheet metal piece 18 however is point-shaped due to the convex design of the permanent magnet 20.

Figure 2:
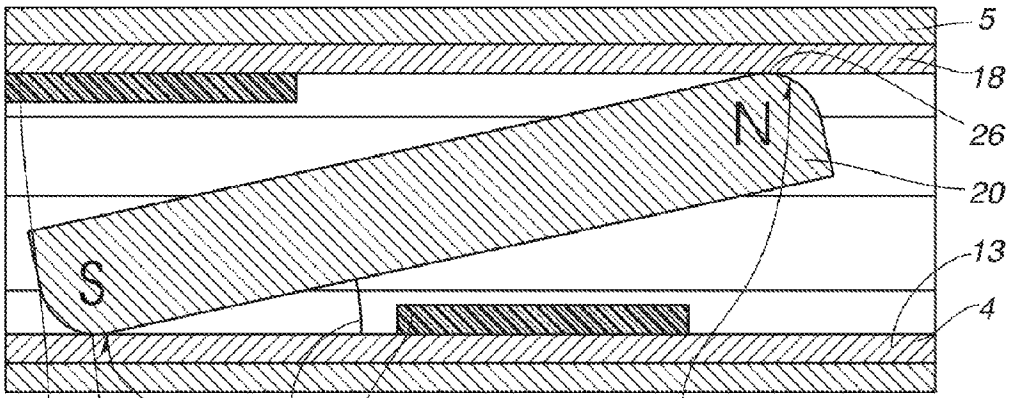
FIG. 2 is a cross-sectional view of the profile rail system according to FIG. 1 along the cutting line II-II.
Figure 3:
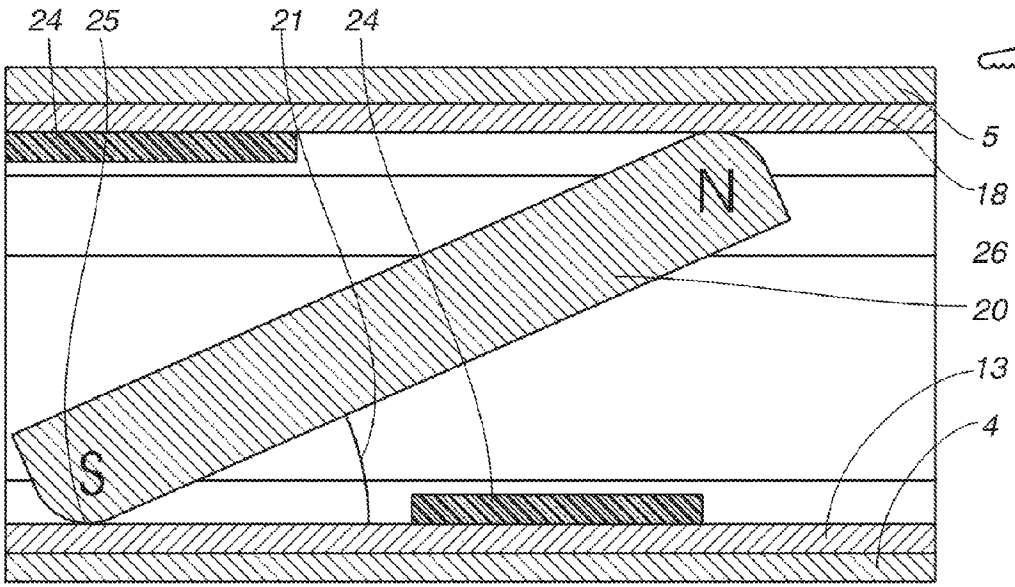
FIG. 3 is the cross-sectional view according to FIG. 2 with the height of the cover rail changed.

It can clearly be seen in FIGS. 2 and 3 that relatively large areas around the contact sites 25, 26 have a very small spacing between the permanent magnet 20 on the one hand and the ferromagnetic sheet metal piece 13, 18 on the other. A relatively high magnetic flux occurs in these areas, resulting in an increased force effect. This force effect is aimed at tipping the permanent magnet 20 so that the angle 21 is reduced. This produces a tensile force towards the base rail 4 that acts on the cover rail 5, and this force presses the cover rail 5 against the floor coverings 3. The ferromagnetic sheet metal pieces 13, 18 can be moved relative to each other.

A comparison of FIGS. 2 and 3 shows that the area of the contact sites 25, 26 is generally dependent on the angle 21 and thus on the spacing between the cover rail 5 and the base rail 4. This results in an about equal force effect of the permanent magnet 20 in both cases so that the cover rail 5 is pulled towards the floor coverings 3 with an approximately constant force regardless of the thickness of the coverings 3.

Figure 4:
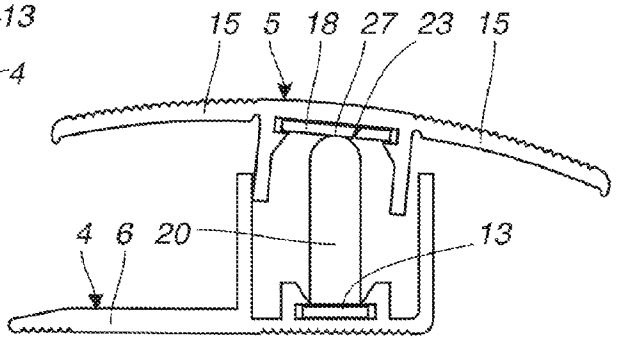
FIG. 4 is a view of the profile rail system 1 from direction IV with the cover rail tilted.

FIG. 4 is a view of the profile rail system 1 from direction IV. Unlike the representation in FIGS. 1 to 3, the cover rail 5 is tilted about a longitudinal axis 27 here. This tilt provides compensation for differences in thickness of the coverings 3 on both sides of the profile rail system 1. The tilting of the cover rail 5 has no effect on the area of the contact site 25 due to the convex rounding 23 of the permanent magnet 20. This ensures that the force effect of the permanent magnet 20 is generally independent of the tilt of the cover rail 5.

In deviation from the embodiment shown, the cover ail may only comprise one cover wing 15. In this case, the profile rail system 1 is used as a border for a covering 3. It is also conceivable to provide cover wings 15 of different lengths to compensate for greater height differences between adjacent coverings than could be compensated by tilting the cover rail 15.

Finally, it is conceivable to arrange the cover wings 15 at an angle to each other to produce a stair edge profile for remodeling staircases.

Since some of the embodiments of this invention are not shown or described, it should be understood that a great number of changes and modifications of these embodiments is conceivable without departing from the rationale and scope of protection of the invention as defined by the claims.

LIST OF REFERENCE SYMBOLS

1 Profile rail system
2 Covering edge
3 Covering
4 Base rail
5 Cover rail
6 Base leg
7 Base
8 Hole
9 Guide rib
10 Holding rib
11 Undercut
12 Holder
13 Ferromagnetic sheet metal piece
14 Profile rail
15 Cover wing
16 Guide rib
17 Holder
18 Ferromagnetic sheet metal piece
19 Undercut
20 Permanent magnet
21 Acute angle
22 Cylindrical rounding
23 Convex rounding
24 Non-ferromagnetic material
25 Contact site
26 Contact site
27 Longitudinal axis

The invention claimed is:

1. A profile rail system for covering at least one covering edge comprising at least one base rail comprising a first ferromagnetic part, at least one cover rail comprising a second ferromagnetic part, said at least one cover rail being spaced from said at least one base rail, and magnetic means for mounting said at least one cover rail on said at least one base rail in a manner permitting adjustment of the distance therebetween, said magnetic mounting means comprising a permanent magnet extending between said at least one cover rail and said at least one base rail, oriented at an angle of less than 90 degrees relative to said at least one base rail and to said at least one cover rail, said magnet having first and second magnetic poles, one of said magnetic poles being situated proximate said first ferromagnetic part, said other of said magnetic poles being situated proximate said second ferromagnetic part, wherein said orientation angle of said permanent magnet changes as the distance between said at least one cover rail and said at least one base rail is adjusted.

2. The profile rail system according to claim 1, wherein at least one of said base rail and said cover rail is of a two-piece design and comprises a non-ferromagnetic profile rail to which said at least one ferromagnetic part is attached.

3. The profile rail system according to claim 2, wherein said profile rail comprises at least one undercut holder into which said ferromagnetic part can be slid.

4. The profile rail system according to claim 2, wherein said profile rail comprises at least one undercut holder into which said ferromagnetic part can be snapped.

5. The profile rail system according to claim 1, wherein said permanent magnet comprises a corner which contacts said base rail, wherein said corner is rounded.

6. The profile rail system according to claim 1, wherein said permanent magnet comprises a corner which contacts said cover rail, wherein said corner is rounded.

7. The profile rail system according to claim 5, wherein said corner is convex.

8. The profile rail system according to claim 6, wherein said corner is convex.

9. The profile rail system according to claim 1, wherein at least one of said base and said cover rails is partially covered by a nonferromagnetic material to prevent level contact with said permanent magnet.

10. The profile rail system according to claim 1, wherein at least one of said base and said cover rails has a partially non-level surface to prevent level contact with said permanent magnet.

11. The profile rail system according to claim 1, wherein said first and second magnetic poles have opposite polarities.

* * * * *